United States Patent [19]

Sadeh et al.

[11] Patent Number: 4,834,008

[45] **Date of Patent: * May 30, 1989**

[54] AUTOMATIC SEWING SYSTEM WITH OPTICAL PATH FOLLOWING

[76] Inventors: Yaacov Sadeh, 11/6 Bialik St., Nes Ziona; Yaacov Makover, Moshav Beit Elazari; Bar-Cochva Mardix, HaRechasim St., Ramat-Gan, all of Israel

[ * ] Notice: The portion of the term of this patent subsequent to Nov. 15, 2005 has been disclaimed.

[21] Appl. No.: 101,084

[22] Filed: Sep. 25, 1987

Related U.S. Application Data

[63] Continuation-in-part of Ser. No. 38,773, Apr. 15, 1987.

[30] Foreign Application Priority Data

Dec. 25, 1986 [IL] Israel ..... 81091

[51] Int. Cl.[4] ..... D05B 21/00

[52] U.S. Cl. ..... 112/121.12

[58] Field of Search ..... 112/121.12, 121.15, 112/308, 309, 306, 102, 103, 2, 153, 262.3; 364/400, 470

[56] References Cited

U.S. PATENT DOCUMENTS

| | | | |
|---|---|---|---|
| 4,498,404 | 2/1985 | Sadeh | 112/121.12 |
| 4,526,116 | 7/1985 | Mannel | 112/121.12 X |
| 4,591,139 | 5/1986 | Engelbart | 112/121.12 X |

*Primary Examiner*—Peter Nerbun

*Attorney, Agent, or Firm*—Silverman, Cass, Singer & Winburn Ltd.

[57] ABSTRACT

Computerized sewing apparatus having incorprated therein edge position sensing apparatus and the capability to modify, in real time, a pre-programmed sewing path in accordance with the actual position of the piece being sewn. The apparatus comprises a sewing head, a workholder, a microprocessor coupled to the workholder for moving the whorkholder relative to the sewing head, apparatus for sensing the edge position of an object on the workholder and arranged to provide an output signal corresponding thereto to the microprocessor, comparator apparatus in the microprocessor to compare the actual edge position with the programmed expected edge position and to determine any deviation, and apparatus coupled to the micrprocessor for modifying the sewing path during sewing to compensate for any such deviation.

12 Claims, 4 Drawing Sheets

AUTOMATIC SEWING SYSTEM WITH OPTICAL PATH FOLLOWING

RELATED APPLICATIONS

The present application is a Continuation-In-Part of our co-pending U.S. patent application Ser. No. 038,773 filed Apr. 15, 1987.

FIELD OF THE INVENTION

The present invention relates to automatic sewing apparatus and, particularly, to computerized sewing apparatus which is gaining widespread use in both the footwear and garment industries.

BACKGROUND OF THE INVENTION

Computerized sewing apparatus was introduced more than a decade ago. Conventional systems perform sewing operations along a predetermined path using a sewing program. The main drawback of such systems lies in the fact that these systems are blind, i.e., they cannot see the work piece which is being sewn. This blindness is a severe handicap for present generation sewing systems. Leather and textiles are flexible materials which can change their size and position before and during the sewing operation. Hence, occasionally, the predetermined sewing path does not match the actual piece being sewn, and the pieces must be disqualified and rejected by quality inspectors.

A further drawback rests in the fact that, in an attempt to maintain accurate positioning of the pieces to be sewn relative to the sewing head, the sewn pieces are firmly held in a complicated workholder. This workholder aims to avoid, with limited success, the potential inaccuracy of pieces placement. Furthermore, the placement of the pieces in this workholder is complicated and, therefore, today is done manually by a trained operator.

There is disclosed in U.S. Pat. No. 4,498,404 automatic sewing apparatus including a manipulator for manipulating the workpiece on a sewing table, the manipulator head and table being designed for selectively applying either positive or negative fluid pressure in order to selectively produce either suction for holding the workpiece, or an air cushion for facilitating movement of the workpiece by the manipulator. The apparatus also includes a workpiece detector continuously monitoring the location of the edge of the workpiece with respect to the sewing head.

The sewing apparatus in U.S. Pat. No. 4,498,404 is a conventional device permitting sewing in one direction only. That is, the workpiece must be manipulated so as to always be presented to the needle from the same side of the sewing head. When a corner is reached necessitating a change in sewing direction, the apparatus stops, the workpiece is rotated through the appropriate angle, and sewing commences again with movement in the original direction. The edge detector provided is a stationary line scan camera of photo-diodes located and oriented so as to monitor the edge of the workpiece relative to a line perpendicular to the direction of sewing.

With the advent of computerized sewing systems, the limitations of uni-directional sewing were felt and systems have been developed permitting multi-directional sewing. In other words, the material to be sewn can approach the needle from any direction. This results in a tremendous time saving when sewing patterns including corners and curves, since the workpiece can be moved in the desired direction without stopping the apparatus. In such a system, however, an edge detector such as shown in U.S. Pat. No. 4,498,404 would be ineffective due to the constantly changing direction of sewing.

Furthermore, there is no discussion in U.S. Pat. No. 4,498,404 of illumination conditions or set up. It is known in the art that without appropriate illumination, no image analysis can be performed effectively. Accordingly, the disclosure with regard to edge detection is this patent is limited in scope.

SUMMARY OF THE INVENTION

It is an object of the present invention to provide multi-directional sewing apparatus with incorporated visual edge position sensing and the capability to modify the sewing path during sewing in accordance with the actual position of the sewn piece.

There is thus provided in accordance with the present invention sewing apparatus including a mainframe, a sewing head permitting multi-directional sewing mounted thereon, and a two dimensional manipulator which moves the workpiece relative to the sewing head in a horizontal plane, the improvement comprising edge position sensing apparatus arranged for simultaneous scanning of an area around the sewing point greater than the field of view of a single camera.

According to one embodiment of the invention, the edge position sensing apparatus includes a scanning camera mounted on a rotating bearing which is attached to the sewing head in such a way that the camera rotates concentric to the needle axis, scanning lines tangential to an imaginary circle around the needle's piercing point in the sewing plane.

Four illuminating lamps are attached to the rotating camera. The camera rotates around the needle using a motor and an encoder which positions the camera relative to the sewing direction in a way that the scanning always cuts the sewing pattern perpendicularly a few millimeters ahead of the sewing point. A special processor analyzes the signal generated by the line scanner and indicates the position, on the scanner, of the edge of the sewn piece. The position data calculated by the processor is transferred to the sewing system processor and is used to modify the sewing path in real time according to the actual piece's position.

According to an alternate embodiment of the invention, the edge sensing apparatus includes at least two stationary cameras affixed about the sewing head with scanning fields of view partially overlapping. A plurality of lights are mounted around the sewing head for providing illumination from any desired direction.

The piece to be sewn is mounted on a simple flat workholder. The pieces are pinned and/or glued to the flat workholder. This mode of attachment enables the automatic loading and unloading of the sewn pieces to and from the workholder.

BRIEF DESCRIPTION OF THE DRAWINGS

Further features and advangages of the invention will be apparent from the description below. The invention is herein described, by way of example only, with reference to the accompanying drawings wherein.

DETAILED DESCRIPTION OF THE INVENTION

Figure 1:
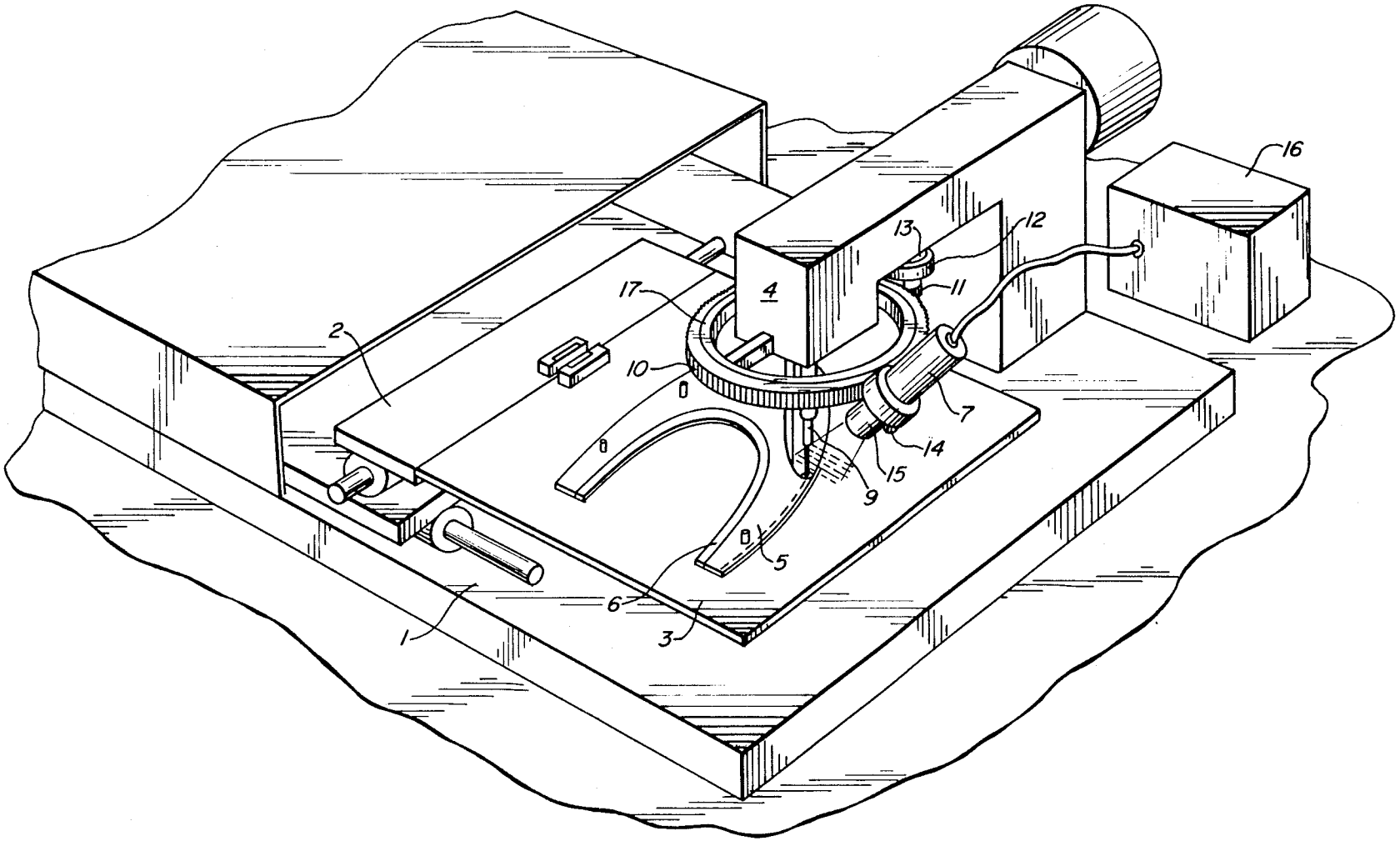
FIG. 1 is a perspective view illusrating one form of computerized sewing apparatus constructed and operative in accordance with the present invention.
Figure 3:
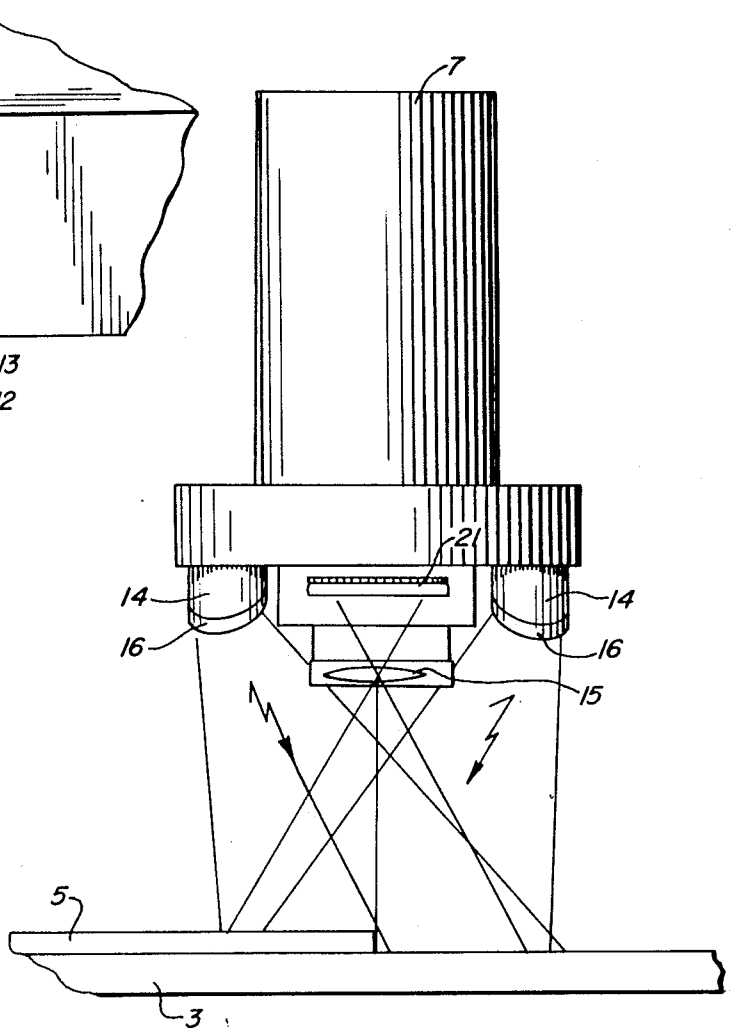
FIG. 3 illustrates the camera and illumination principle of the sewing apparatus of FIG. 1.
Figure 2:
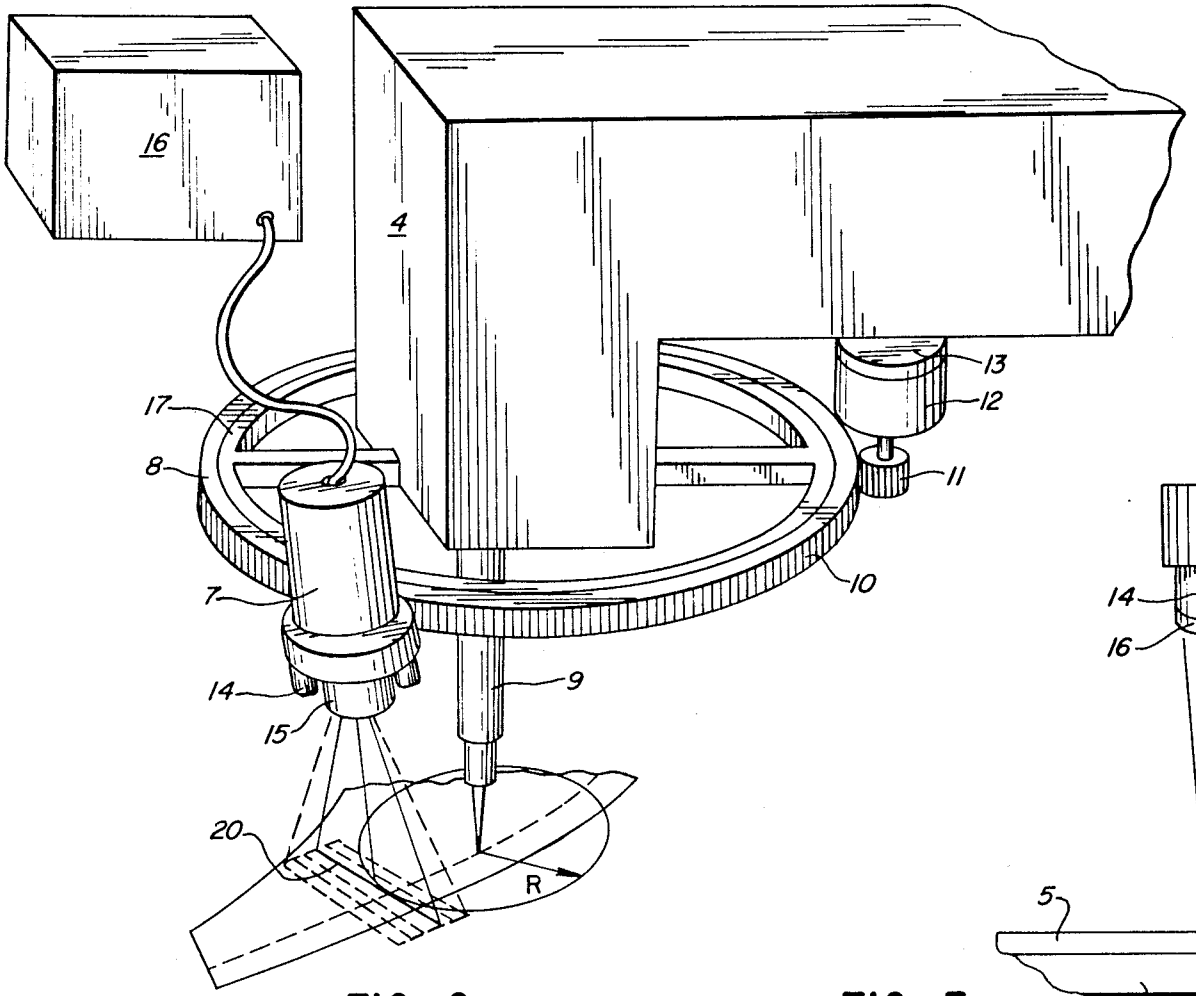
FIG. 2 is an enlarged detailed view of the optical edge sensor and its attachment relative to the sewing head.
Figure 4:
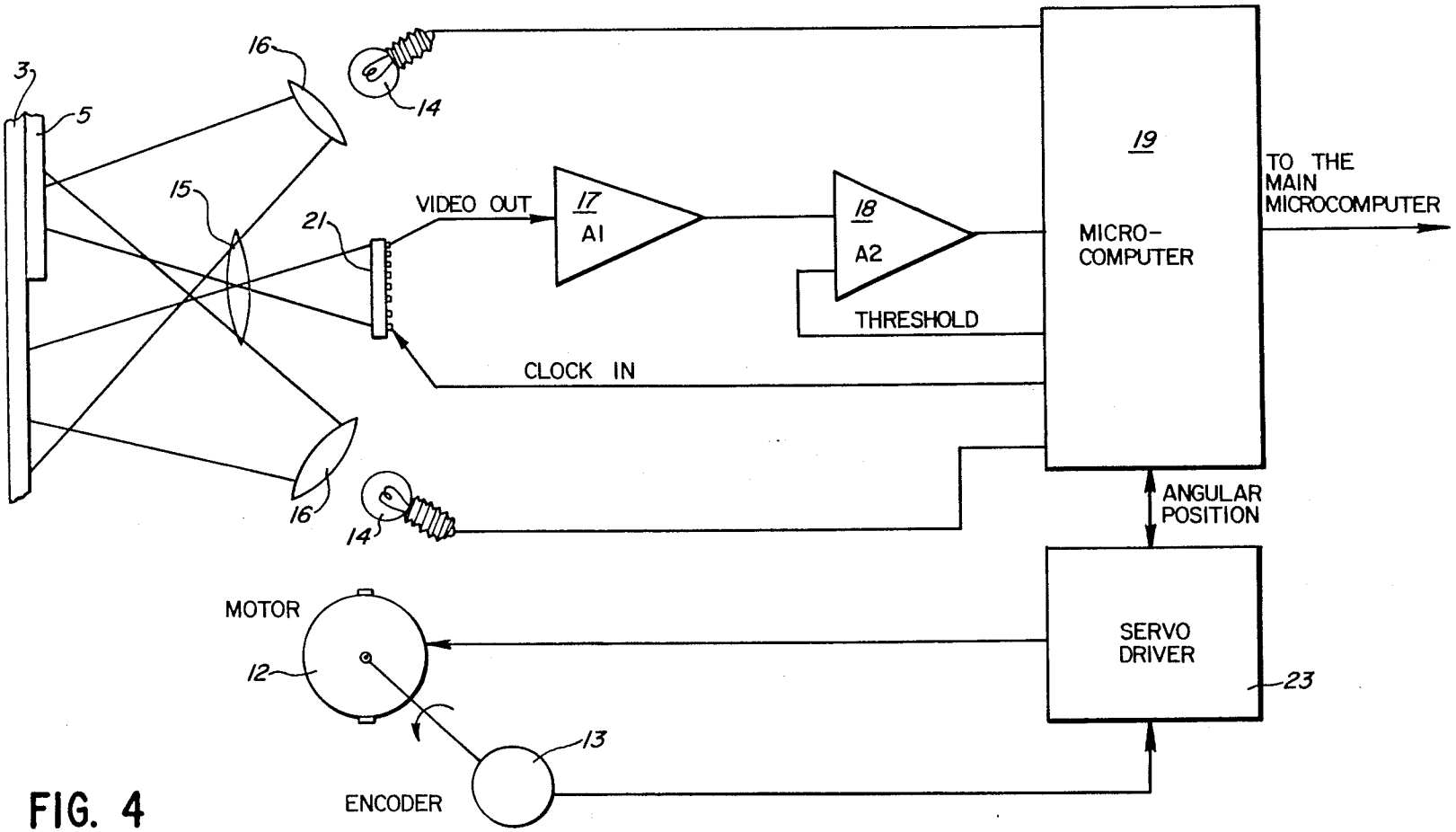
FIG. 4 is a block diagram of the edge sensing hardware and servo driver used to analyze and process the signal from the scanner and to transfer the information to the main processor.

The present invention relates to computerized multi-directional sewing apparatus having incorporated therein edge position sensing means and the capability to modify, in real time, a pre-programmed sewing path in accordance with the actual position of the piece being sewn. The apparatus comprises a sewing head permitting multi-directional sewing, a workholder, a microprocessor coupled to the workholder for moving the workholder relative to the sewing head, means for sensing the edge position of an object on the workholder and arranged to provide an output signal corresponding thereto to the microprocessor, comparator means in the microprocessor to compare the actual edge position with the programmed expected edge position and to determine any deviation, and means coupled to the microprocessor for modifying the sewing path during sewing to compensate for any such deviation.

One preferred embodiment of the invention will be described hereinbelow with reference to FIGS. 1 to 4. The sewing apparatus comprises a mainframe 1 on which is mounted a sewing head 4. Sewing head 4 may comprise any conventional sewing head which is adapted to be driven by computerized commands, is arranged for multi-directional sewing, and which includes a sewing needle affixed thereto via the needle bar 9.

A workholder 3 is coupled to the mainframe by a two-dimensional manipulator 2 for translating the workholder relative to the sewing head in any direction in the horizontal (X-Y) plane. Workholder 3 comprises a flat surface onto which the pieces 5 to be sewn are glued and/or taped with double sided adhesive coated tape 6, or retained thereon by any other known means. Manipulator 2 comprises any known X-Y table mechanism which is adapted to be driven by computerized commands.

A scanning camera 7 is coupled for rotation about the sewing head 4 with the needle bar 9 as its axis of rotation. In the illustrated embodiment, a fixed circular bearing 17 is affixed to the sewing head, concentric with needle bar 9. Coupled to fixed bearing 17 is an external rotary bearing 8 on which scanning camera 7 is mounted. A circular gear train 10 encircles external rotary ring 8 and is coupled to a small gear or pinion 11 which transfers to it the rotary motion. Gear 11 is mounted on the axis of a servo motor 12 which also rotates a coaxial shaft encoder 13. Encoder 13 may comprise any conventional incremental encoder of suitable size, such as, for example, a series RI incremental encoder of Sopelem, Levallois-Perret, France. Thus, the angular position of the camera is controlled by rotating the external ring of the bearing to which it is attached, its position being measured by the encoder. Alternately, any other mounting means permitting computer-controlled rotation about the needle bar axis may be utilized.

Servo motor 12 which rotates the camera is driven by a servo driver 23. Servo driver 23, in turn, is controlled by a microprocessor 19 which is programmed to rotate the camera in accordance with the sewing pattern so that the direction of scanning is always perpendicular to the direction of sewing, a few millimeters ahead of the sewing point. This servo system may comprise any conventional closed-loop position control system, such as that marketed by E G & G Torque Systems, Massachusetts, U.S.A.

At least two lamps 14 are mounted on the camera along the axis of the scanning lines. Preferably, four lamps 14 are provided, one on each side of the scanning area. Each lamp 14 includes a collimating lens 16 to project a narrow beam of light on the sewn piece. Lamps 14 are controlled by microprocessor 19 such that light from one lamp at a time is projected on the sewn piece 5 in a direction that either causes the edge of the sewn piece to cast a shadow on the workholder 3 or enhances the edge by illuminating the edge directly. It will be appreciated that the illumination is programmed into microprocessor 19 together with the sewing pattern.

According to one preferred embodiment, scanning camera 7 comprises a line scanner including an imaging lens 15 which projects a one dimensional image onto a line scanning detector 21 inside the camera body. Detector 21 may comprise a charge coupled device (CCD), such as the CCD 143 of Fairchild Weston Corp., U.S.A., a current injection device (CID) or any other equivalent line detector. An example of a suitable camera is the CCD 5000 micro-camera marketed by Fairchild Weston Corp. Camera 7 is arranged to scan an imaginary line 20 on the piece 5 being sewn which is mounted on workholder 3. Line 20 is tangential to an imaginary circle around the needle's piercing point in the sewing plane.

According to an alternate embodiment, scanning camera 7 comprises an area scanning camera, such as a vidicon camera or a two-dimensional CCD, instead of a line scanner. An area scanning camera is arranged to scan a plurality of imaginary lines 20 (shown in broken lines), each of which is tangential to an imaginary circle around the needle's piercing point in the sewing plane.

Operation of the sewing apparatus illustrated in FIGS. 1 to 4 is as follows. A main microprocessor (not shown) directs workholder 3 to move the sewn piece 5 in the required directions in order to generate the sewing pattern along the edge of the piece. The main microprocessor also controls microprocessor 19. It will be appreciated that a single microprocessor may be utilized to combine both functions. However, this is less practical.

As described above, lamps 14 provide diagonal illumination of the sewn piece 5 so that its edge casts a shadow on workholder 3. Camera 7 is rotated in accordance with the sewing pattern and synchronized with the workholder so that the line of scanning is always perpendicular to the direction of sewing, a few millimeters ahead of the sewing point. The contrast generated by the shadow enables the easy observation of the edge position on the image generated on the scanner.

The edge position is determined by transferring the video signal generated by CCD scanner 21 into a video amplifier 17. The amplification of this amplifier is controlled by the microprocessor 19 in a way that ensures a video signal well within the dynamic range of the amplifier. The pixel of the CCD scanner in which the edge is imaged generates a different output voltage. A comparator 18 compares the output signal from amplifier 17 with a threshold level generated by the microprocessor 19, and outputs a triggering voltage whenever the video voltage from amplifier 17 varies relative to the threshold. This triggering voltage freezes the count of the pixel rate clock in a counter inside the microprocessor 19, as known per se. The data in this counter indicates the edge position of sewn piece 5 in pixel units.

Microprocessor 19 analyzes the signal generated by the scanner and indicates the position, on the scanner, of the edge of the sewn piece. The position data calculated by microprocessor 19 is transferred to the sewing system main processor. This information, together with the camera's angular position relative to the sewing head and workholder location, enables the main microprocessor to calculate the actual position of the edge in the scanning point. The expected edge position is known by the main processor which then determines the adjustment required to correct the sewing pattern. The main processor then modifies the sewing path in real time according to the piece's actual position by causing X-Y manipulator 2 to change the position of workholder 3.

Figure 6:
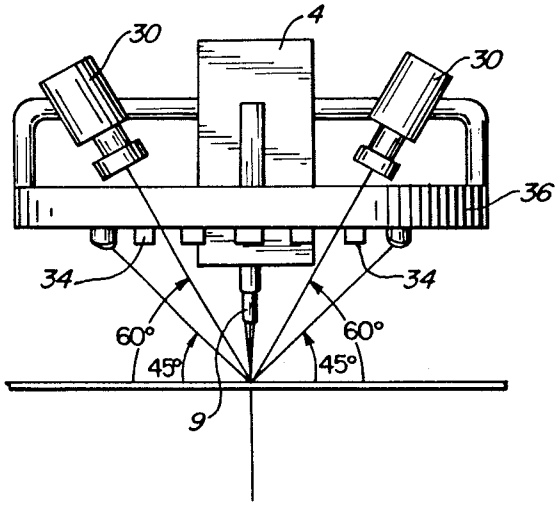
FIG. 6 is a front view of the apparatus of FIG. 5.
Figure 7:
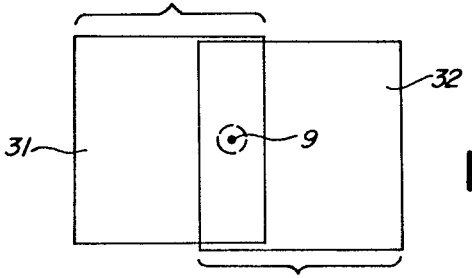
FIG. 7 is a schematic illustration of the scanned area in the apparatus of FIG. 5.
Figure 5:
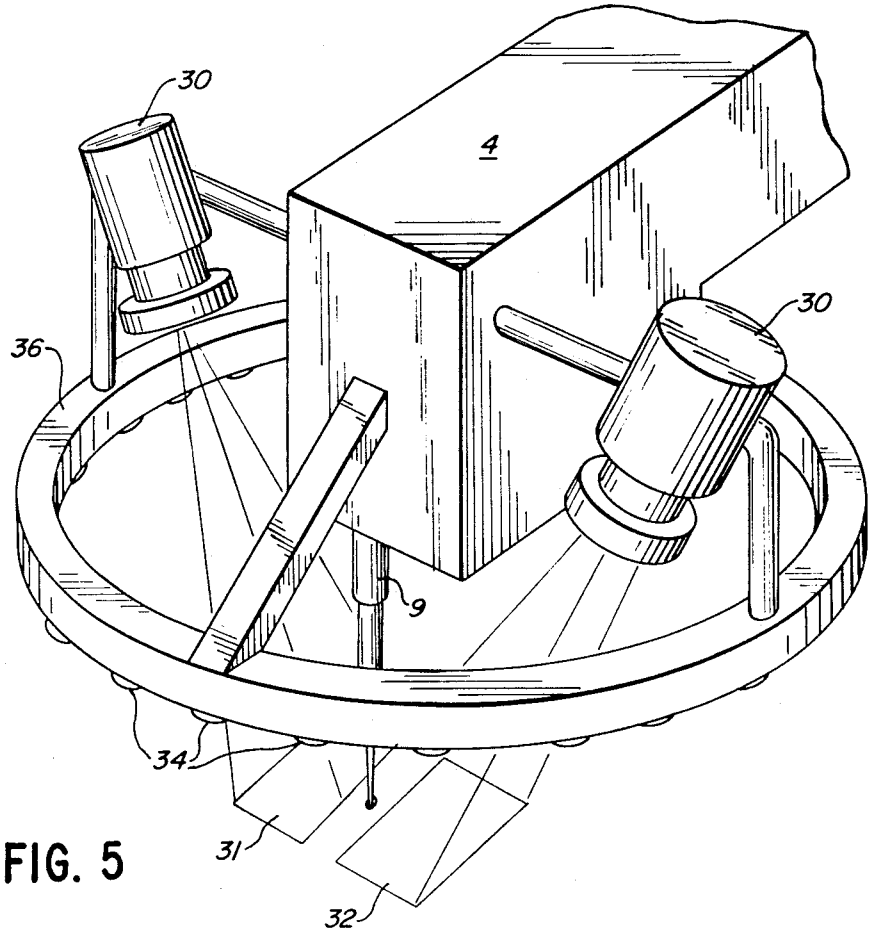
FIG. 5 is a perspective view illustrating an alternate form of computerized sewing apparatus constructed and operative in accordance with the present invention.

Referring now to FIGS. 5 to 7 there is shown computerized sewing apparatus constructed and operative in accordance with an alternate embodiment of the invention. This embodiment is similar to that of FIG. 1 in all respects except the edge sensing apparatus. Like elements have like reference numerals and will not be described again.

The edge sensing apparatus of this embodiment comprises two scanning cameras 30 affixed to the sewing head 4 at an angle of 180 degrees from one another, as can be seen most clearly in FIG. 6. Each camera 30 comprises an area scanning camera, such as a vidicon camera or a two-dimensional CCD camera, preferably mounted of an angle of 30 degrees relative to the vertical. The cameras are disposed so as to scan the area 360 degrees around the needle in needle holder 9, as shown in FIG. 7. Preferably, there is partial overlap of the fields of view 31 and 32 of the first and second cameras 30.

Cameras 30 are controlled by microprocessor 19 which activates the appropriate camera in whose field of view the sewing is programmed to occur at the time. Thus, at any given time, generally only one camera will be operative for scanning. It will be appreciated that more than two cameras may be provided, if desired. Preferably, they are equally spaced around the sewing head for symmetrical overlap.

It will be appreciated that other edge sensing devices, other than cameras, may alternately be employed. It is important that 360 degrees around the needle be scannable by the sensing devices utilized.

A plurality of lamps 34 are mounted on a circular bearing 36 disposed concentrically with the needle axis. Lamps 34 are preferably equally spaced around the ring and are oriented diagonally to the sewing area. Most preferably, the lamps are oriented at about 45 degrees to the sewing area, as shown in FIG. 6. According to a preferred embodiment, between 12 and 24 lamps 34 are provided in bearing 36. Each lamp 34 includes a built-in collimating lens (not shown) which collimates the light exiting therefrom into parallel rays which cover the field of view.

Lamps 14 are controlled by microprocessor 19, as described with reference to FIG. 1, such that light from one lamp at a time is projected on the sewn piece 5 in a direction that either causes the edge of the sewn piece to cast a shadow on the workholder 3, or enhances the edge of piece 5 by illuminating it directly, if using the oppositely disposed lamp. It will be appreciated that the illumination and camera operation are programmed into microprocessor 19 together with the sewing pattern.

The advantages of the embodiment of FIGS. 5 to 7 are several. First, the vision system is stationary; there is no need to rotate the camera, which results in a simpler system. The directional illumination is provided by selection of the appropriate lamp to be illuminated in order to enhance the required edge according to the orientation of the edge to be seen.

Second, there is no problem of rapid response to sharp direction changes which can occur with mechanical scanning. Switching from one lamp to another for a 90 degree direction change, for example, is fast and there is no need to wait for a 90 degree rotation of the entire camera and lamps assembly.

It will be appreicated by those skilled in the art that the invention is not limited to what has been shown and described hereinabove by way of example. Rather, the invention is limited solely by the claims which follow.

We claim:

1. In computerized sewing apparatus comprising:

a sewing head permitting multi-directional sewing mounted on a main frame;

a workholder coupled to the main frame and manipulated relative to the sewing head in a horizontal plane by a two-dimensional manipulator;

a microprocessor coupled to said manipulator for causing the workholder to move in a pre-programmed pattern relative to the sewing head;

the improvement comprising:

means for sewing the edge position of an object on said workholder and arranged to provide an output signal corresponding thereto to said microprocessor;

said sensing means being arranged for simultaneous scanning of an area around the sewing point greater than the field of view of a single scanner;

said sensing means including a scanning camera coupled to the sewing head and disposed for rotation concentric to a needle bar mounted in said sewing head and arranged for scanning at least one line tangential to an imaginary circle around the needle's piercing point in the sewing plane;

said camera comprising means for generating a first output signal corresponding to said at least one scanned line;

encoder means coupled to said camera for providing a second output signal corresponding to the position of said camera;

processor means for receiving said first and second output signals and converting them into a third output signal corresponding to the edge position of said object, and providing said third output signal to said microprocessor;

comparator means in said microprocessor to compare the actual edge position with the programmed expected edge position and to determine any deviation; and means coupled to said microprocessor for modifying the sewing path during sewing to compensate for any such deviation.

2. Sewing apparatus according to claim 1 and wherein said means for sensing comprises a line scanning camera arranged to scan a single line tangential to an imaginary circle around the needle's piercing point in the sewing plane.

3. Sewing apparatus according to claim 1 and wherein said means for sensing comprises an area scanning camera arranged for scanning a plurality of lines tangential to an imaginary circle around the needle's piercing point in the sewing plane.

4. Sewing apparatus according to claim 1 and wherein said workholder comprises a flat holder mounted on a two dimensional manipulator for movement in the horizontal plane; said manipulator being activated by said microprocessor.

5. Sewing apparatus according to claim 4 and wherein said object is affixed to said holder by glue.

6. Sewing apparatus according to claim 4 and wherein said object is affixed to said holder by double-sided adhesive tape.

7. Sewing apparatus according to claim 1 and further comprising at least two illuminating lamps coupled to said camera and disposed for diagonal illumination of the edge of said object being scanned; said lamps being activated by said processor means.

8. Sewing apparatus according to claim 7 and wherein said at least two illuminating lamps comprise four illuminating lamps.

9. Sewing apparatus according to claim 1 and wherein said camera is coupled to said sewing head by means of:

a fixed circular bearing affixed to the sewing head, concentric with the needle bar;

an external rotary bearing coupled to the fixed bearing;

a circular gear train encircling said external rotary bearing to which said camera is coupled, said gear train being driven by a pinion;

a servo motor arranged to rotate said pinion; and a shaft encoder coaxial with said servo motor.

10. Sewing apparatus according to claim 3 and further comprising four illuminating lamps coupled to said camera and disposed for diagonal illumination of the edge of said object being scanned; said lamps being activated by said procesor means.

11. Computerized sewing apparatus comprising:

a sewing head mounted on a main frame;

a workholder coupled to the main frame and comprising a flat holder mounted on a two dimensional manipulator for movement in the horizontal plane;

a microprocessor drivingly coupled to said manipulator for causing the workholder to move relative to the sewing head;

means for sensing the edge position of an object on said workholder comprising:

an area scanning camera coupled to the sewing head and disposed for rotation concentric to a needle bar mounted in said sewing head and arranged for scanning a plurality of lines each tangential to an imaginary circle around the needle's piercing point in the sewing plane;

four illuminating lamps coupled to said camera and disposed for diagonal illumination of the edge of said object being scanned;

said camera comprising means for generating a first output signal corresponding to said plurality of scanned lines;

encoder means coupled to said camera for providing a second output signal corresponding to the position of said camera; and processor means for activating said lamps and for receiving said first and second output signals and converting them into a third output signal corresponding to the edge position of said object, and providing said third output signal to said microprocessor;

comparator means in said microprocessor to compare the actual edge position with the programmed expected edge position and to determine any deviation; and means coupled to said microprocessor for modifying the sewing path during sewing to compensate for any such deviation.

12. In computerized sewing apparatus comprising:

a sewing head permitting multi-directional sewing mounted on a main frame;

a workholder coupled to the main frame and manipulated relative to the sewing head in a horizontal plane by a two dimensional manipulator;

a microprocessor coupled to said manipulator for causing the workholder to move in a pre-programmed pattern relative to the sewing head;

the improvement comprising:

means for sensing the edge position of an object on said workholder and arranged to provide an output signal corresponding thereto to said microprocessor;

said sensing means being arranged for simultaneous scanning of an area around the sewing point greater than the field of view of a single scanner;

said sensing means including at least two stationary cameras disposed about the sewing head with scanning fields of view partially overlapping and together covering the entire 360 degrees two dimensional area around a needle bar disposed in said sewing head;

a plurality of lights mounted about the sewing head for providing illumination from any desired direction;

comparator means in said microprocessor to compare the actual edge position with the programmed expected edge position and to determine any deviation; and means coupled to said microprocessor for modifying the sewing path during sewing to compensate for any such deviation.

* * * * *

UNITED STATES PATENT AND TRADEMARK OFFICE

CERTIFICATE OF CORRECTION

PATENT NO. : 4,834,008

DATED : May 30, 1989

INVENTOR(S) : Yaacov Sadeh, Yaacov Makover and Bar Cochva Mardix

It is certified that error appears in the above-identified patent and that said Letters Patent is hereby corrected as shown below:

Column 6, Claim 1, line 43, change "sewing" to --sensing--.

Signed and Sealed this

Sixth Day of March, 1990

*Attest:*

JEFFREY M. SAMUELS

*Attesting Officer*

*Acting Commissioner of Patents and Trademarks*